US005629726A

United States Patent [19]

Yamasa

[11] Patent Number: 5,629,726

[45] Date of Patent: May 13, 1997

[54] IMAGE FORMING APPARATUS WITH ELECTROSTATICALLY CONTROLLED DEVELOPER PARTICLE MANIPULATION

[75] Inventor: Hideo Yamasa, Yamatokoriyama, Japan

[73] Assignee: Sharp Kabushiki Kaisha, Osaka, Japan

[21] Appl. No.: 550,767

[22] Filed: Oct. 31, 1995

[30] Foreign Application Priority Data

Nov. 9, 1994 [JP] Japan ..... 6-275313

[51] Int. Cl.[6] ..... B41J 2/385

[52] U.S. Cl. ..... 347/55; 347/151

[58] Field of Search ..... 347/55, 151, 158

[56] References Cited

U.S. PATENT DOCUMENTS

| | | | |
|---|---|---|---|
| 3,776,722 | 12/1973 | Cantarano | 430/126 |
| 4,949,103 | 8/1990 | Schmidlin et al. | 347/55 |
| 5,036,341 | 7/1991 | Larsson | 347/55 |
| 5,170,185 | 12/1992 | Takemura et al. | 347/55 |
| 5,229,794 | 7/1993 | Honma et al. | 347/55 |
| 5,357,274 | 10/1994 | Kitamura | 347/55 |
| 5,523,777 | 6/1996 | Kitamura | 347/55 |

FOREIGN PATENT DOCUMENTS

| | | | |
|---|---|---|---|
| 0463743 | 1/1992 | European Pat. Off. . | |
| 0488652 | 6/1992 | European Pat. Off. . | |
| 0587366 | 3/1994 | European Pat. Off. . | |
| 04142952 | 5/1992 | Japan . | |
| 84963 | of 1993 | Japan . | |
| 5-42712 | 2/1993 | Japan | 347/55 |

*Primary Examiner*—Arthur T. Grimley
*Assistant Examiner*—Sophia S. Chen
*Attorney, Agent, or Firm*—David G. Conlin; Brian L. Michaelis

[57] ABSTRACT

An image forming apparatus is provided with a control electrode having a plurality of gates where negatively charged toner passes through, and the control electrode is arranged such that an electrode layer is formed on an insulating layer made of synthetic resin having electron attractiveness stronger than that of synthetic resin contained in the toner. For this reason, on the control electrode, when the toner flies to contact with the insulating layer, electrostatic force (repulsive force) acts between negative charges of the contact portion and the negative charges of the toner, and thus the charges repulse each other. Therefore, the toner does not adhere to the insulating layer. In such a manner, the adhesion of the toner to the control electrode is prevented and thus each gate is not blocked. As a result, even after long or frequent use of the control electrode, the flying of the toner by the control electrode can be stably controlled, thereby making it possible to obtain an image with excellent quality. Therefore, even if the control electrode is not maintained, namely, cleaned or replaced, an image with excellent quality can be obtained stably for a long time.

33 Claims, 8 Drawing Sheets

Vc : TONER FLYING POTENTIAL
Vc-: TONER FLYING SUPPRESSING POTENTIAL

Vs : POTENTIAL OF TONER HOLDER
Vb : POTENTIAL OF COUNTER ELECTRODE
Vm : POTENTIAL OF CONTROL ELECTRODE
Vo : POTENTIAL ON CONTROL ELECTRODE BEFORE APPLYING Vm TO CONTROL ELECTRODE

Eth : TONER FLYING START ELECTRIC FIELD
Em : INTENSITY OF ELECTRIC FIELD WHEN Vm IS APPLIED TO CONTROL ELECTRODE
Eo : INTENSITY OF ELECTRIC FIELD BEFORE Vm IS APPLIED TO CONTROL ELECTRODE 1
21
5
22
26
23
17
19
POTENTIAL
C
A
Vs
Vm
Vo
Vb
INTENSITY OF ELECTRIC FIELD
Em
Eth
Eo
COUNTER ELECTRODE 21
CONTROL ELECTRODE 23
TONER HOLDER 19

IMAGE FORMING APPARATUS WITH ELECTROSTATICALLY CONTROLLED DEVELOPER PARTICLE MANIPULATION

FIELD OF THE INVENTION

The present invention relates to an image forming apparatus, which is applied to a printing section of a digital copying apparatus and a facsimile apparatus and to a digital printer, for forming an image on a recording medium by allowing developing particles to fly.

BACKGROUND OF THE INVENTION

Conventionally, an image forming apparatus for outputting an image signal as a visible image on a recording medium, such as a sheet, adopts a method, generally called as xerography. Such an image forming apparatus forms an electrostatic pattern by an optical writing means on a developer having electrical-optical properties, namely, on a photoreceptor, and allows toner which is developing particles to adhere to the electrostatic pattern so as to develop it. Thereafter, the image forming apparatus transfers an developed image to a recording medium such as a sheet so as to form an image signal as a visible image on a recording medium. Concretely, the image signal is converted into a light signal by a light generating unit, such as a laser, an LED (Light Emitting Diode), and the light is irradiated to the photoreceptor which has been uniformly charged so as to form the electrostatic pattern according to light intensity on the surface of the photoreceptor. Successively, the charged toner is allowed to contact with or to fly to the electrostatic pattern so that developing is made, and a toner image is formed on the surface of the photoreceptor. Then, after the toner image is transferred to the recording medium by electrical attractive force, pressure or both of them, the toner image on the recording medium is fixed thereon by pressure, heat or both of them.

In addition, another image forming apparatus forms a charge pattern according to an image signal on a dielectric drum and develops the charge pattern so as to obtain a visible image on a recording medium. This image forming apparatus includes a charged particle current generator, a charged particle current control grid and an dielectric drum as a developer. When a voltage to be applied to the charged particle current control grid is controlled according to an image signal, the charged particle current to be generated by the charged particle current generator is controlled. Then, a charge pattern according to the image signal is formed on the dielectric drum by the charged particles, and the charge pattern is developed by toner so that a toner image is formed on the dielectric drum. Thereafter, in the same manner as that of the previously-mentioned image forming apparatus, the toner image is transferred to and fixed on the recording medium.

However, In such a kind of the image forming apparatus, after the image signal is once formed as an electrostatic latent image on the developer, such as a photoreceptor or a dielectric drum, a toner image is obtained by developing the electrostatic latent image by using toner. Therefore, in the above image forming apparatus, a developer with a special structure for forming the electrostatic latent image is required, and also electrostatic latent image writing means and charge eliminating means for eliminating residual charges of the developer are required. Moreover, a structure that transfers the toner image formed on the developer to the recording medium is complicated. For this reason, an arrangement of the image forming apparatus becomes complicated and there is a limit in miniaturizing the apparatus.

Meanwhile, for example, PCT Unexamined Patent Publication No. 1-503221/1989 (Tokuhyohei 1-503221) discloses an image forming apparatus for directly forming a toner image on a recording medium such as a sheet without the process mentioned above for forming the toner image once on the developer. In this image forming apparatus, an electric field, which allows the toner to fly from a toner holder towards a plate electrode, is given between the toner holder and the plate electrode, and the flying of the toner is controlled by a mesh-like grid electrode provided between the toner holder and the plate electrode. Thereafter, the toner image is directly formed on the recording medium provided on a side opposite to the toner holder on the plate electrode.

However, in the image forming apparatus disclosed in the above Publication, since the grid electrode has a mesh-like shape, in order to obtain an image with excellent quality by satisfactorily controlling the flying of toner, an arrangement of the grid electrode becomes complicated. For this reason, it is hard to mass-produce the grid electrodes, thereby decreasing mass productivity of the image forming apparatus.

Therefore, in order to obtain a grid electrode with a simple arrangement, the inventor of the present invention discovered a grid electrode arranged such that an electrode layer is formed on an insulating substrate made of resin after due examination. The grid electrode (control electrode) is obtained such that after an electrode layer made of a metal film is formed on one surface of a resin film, which is provided to a generally flexible substrate, etc., made of polyimide, polyester, polyethylene, etc., by using a prescribed method, a protective layer made of polyimide, polyester, polyethylene, etc. is formed so as to cover the electrode layer, and a plurality of holes (gates) which are passage sections for toner (developing particles) are provided to the resin film and the protective layer by using a prescribed method. Therefore, the arrangement of the grid electrode becomes simple, and the grid electrode can be easily mass-produced. When the grid electrode is used, the flying of the toner is satisfactorily controlled so that an image with excellent quality can be obtained.

However, in the above grid electrode, when the toner which is charged particles flies and contacts with the resin film or the protective layer, attractive force is generated between a surface of the resin film or of the protective layer and the toner due to electrostatic force, and then the toner adheres to the surface of the resin film or of the protective layer. In other words, the toner is held on the surface of the resin film or of the protective layer by the electrostatic force. For this reason, when the grid electrode is used for a long time or frequently, a lot of toner adheres to the circumference of the holes, thereby blocking the holes. Therefore, in order to obtain excellent image quality stably for a long time, the grid electrode should be maintained, namely, cleaned or replaced so that the toner which has adhered to the holes are removed, or the grid electrode should be replaced according to frequency of usage.

SUMMARY OF THE INVENTION

It is an object of the present invention to provide an image forming apparatus which is capable of obtaining an image with excellent quality stably for a long time without maintenance such as cleaning, replacement of the control electrode.

In order to achieve the above object, the image forming apparatus of the present invention includes negatively charged developing particles, a holder for holding the developing particles, a counter electrode provided oppositely to the holder, electric field forming means for forming an electric field which allows the developing particles to fly by generating prescribed potential difference between the holder and the counter electrode, a control electrode having a plurality of gates for letting the flying developing particles pass through, which is provided between the holder and the counter electrode, and control electrode control means for controlling the potential given by the control electrode and for controlling the flying of the developing particles passing through each gate by changing the electric field formed between the holder and the counter electrode. The control electrode includes an insulating layer made of resin with electron attractiveness stronger than that of resin contained in the developing particles, and a plurality of electrode layers, to which a potential is given, formed on the insulating layer.

With the above arrangement, the control electrode having a plurality of gates which are passing sections for negatively charged developing particles is arranged such that the electrode layer is formed on the insulating layer made of resin having electron attractiveness stronger than that of resin contained in the developing particles. For this reason, on the control electrode, when the charged developing particles fly to contact with the insulating layer, its contact portion on the insulating layer receives a part of charges from the developing particles to be negatively charged. Therefore, electrostatic force (repulsive force) acts between negative charges near the contact portion on the insulating layer and the negative charges of the developing particles and thus the charges repulse each other. Therefore, the developing particles do not adhere to the insulating layer. Namely, the developing particles are not held on the surface of the insulating layer.

In such a manner, since the adhesion of the negatively charged developing particles to the control electrode is prevented, the gates are not blocked. As a result, even after long or frequent use of the control electrode, the flying of the developing particles by the control electrode can be stably controlled, thereby making it possible to obtain an image with excellent image. This makes it possible to provide the image forming apparatus which is capable of stably obtaining an image with excellent quality for a long time even if the control electrode is not maintained, namely, cleaned or replaced. Moreover, since the maintenance is not necessary, running cost can be suppressed.

It is desirable that the above image forming apparatus further includes a protective layer, which is formed on the electrode layer and made of resin with electron attractiveness stronger than that of resin contained in the developing particles.

With the above arrangement, the protective layer for protecting the electrode layer, which is made of resin having electron attractiveness stronger than that of resin contained in the developing particles is formed on the surface of the control electrode. For this reason, when the developing particles fly to contact with the protective layer, the contact portion of the protective layer receives a part of charges from the developing particles to be negatively charged. Therefore, since electrostatic force (repulsive force) acts between negative charges of the contact portion and the negative charges of the developing particles and thus the charges repulse each other, the developing particles do not adhere to the protective layer. Namely, the developing particles are not held on the surface of the protective layer.

As a result, even if the control electrode is not maintained, namely, cleaned, replaced, etc. an image with excellent quality can be stably obtained for a long time.

In addition, in order to achieve the above object, the image forming apparatus of the present invention includes positively charged developing particles, a holder for holding the developing particles, a counter electrode provided oppositely to the holder, electric field forming means for forming an electric field which allows the developing particles to fly by generating prescribed potential difference between the holder and the counter electrode, a control electrode having a plurality of gates for letting the flying developing particles pass through, which are provided between the holder and the counter electrode, and control electrode control means for changing the electric field formed between the holder and the counter electrode by controlling the potential given by the control electrode so as to control the flying of the developing particles, which pass through each gate. The control electrode includes an insulating layer made of resin with electron repelling stronger than that of resin contained in the developing particles and a plurality of electrode layers, to which a potential is given, formed on the insulating layer.

With the above arrangement, the control electrode having a plurality of gates which are passing sections for positively charged developing particles is arranged such that the electrode layer is formed on the insulating layer made of resin having electron repelling stronger than that of resin contained in the developing particles. For this reason, on the control electrode, when the charged developing particles fly to contact with the insulating layer, the vicinity of the contact portion on the insulating layer receives a part of charges from the developing particles to be positively charged. Therefore, since electrostatic force (repulsive force) acts between the positive charges in the vicinity of the contact portion on the insulating layer and the positive charges of the developing particles and thus the charges repulse each other, the developing particles do not adhere to the insulating layer. Namely, the developing particles are not held on the surface of the insulating layer.

In such a manner, since the adhesion of the positively charged developing particles to the control electrode is prevented, the gates are not blocked. Therefore, even after long or frequent use of the control electrode, the flying of the developing particles by the control electrode can be stably controlled, thereby making it possible to obtain an image with excellent quality. This makes it possible to provide the image forming apparatus which is capable of stably obtaining an image with excellent quality for a long time even if the control electrode is not maintained, namely, cleaned or replaced. Moreover, the maintenance is not necessary, running cost can be suppressed.

It is desirable that the image forming apparatus further includes a protective layer which is formed on the surface of the electrode layer on the control electrode and which is made of resin having electron repelling stronger than that of resin contained in the developing particles.

With the above arrangement, the protective layer for protecting the electrode layer, which is made of resin having electron repelling stronger than that of resin contained in the developing particles is formed on the surface of the electrode layer. For this reason, when the developing particles fly to contact with the protective layer, the vicinity the contact portion on the protective layer receives a part of the charges from the developing particles to be positively charged. As a result, electrostatic force acts between the positive charges of the protective layer and the positive charges of the developing particles and thus the charges repulse each other, so the developing particles do not adhere to the protective layer. Namely, the developing particles are not held on the surface of the protective layer.

This makes it possible to stably obtain an image with excellent quality for a long time even if the control electrode is not maintained, namely, cleaned or replaced.

For fuller understanding of the nature and advantages of the invention, reference should be made to the ensuing detailed description taken in conjunction with the accompanying drawings.

BRIEF DESCRIPTION OF THE DRAWINGS

FIG. 9(*b*) is an explanatory drawing which explains an applied potential to each section for controlling the flying of toner in the image forming section; and FIG. 9(*c*) is an explanatory drawing which explains intensity of an electric field of each section by the applied potential.

FIG. 10(*b*) is an explanatory drawing which explains an applied potential to each section for controlling flying of toner in the image forming section other than the flying of toner in FIG. 9(*b*); and FIG. 10(*c*) is an explanatory drawing which explains intensity of an electric field of each section by the applied potential.

DESCRIPTION OF THE EMBODIMENTS

The following will explain one embodiment of the present invention referring to FIGS. 1 through 10. Here, the explanation will be given as to the case where an arrangement of the image forming apparatus of the present invention is applied to a digital copying apparatus. Moreover, in the following explanation, a digital copying apparatus having an arrangement which correspond with negatively charged toner will be mentioned in detail. In the case where positively charged toner is used, polarity of each applied voltage may be suitably set accordingly.

Figure 4:
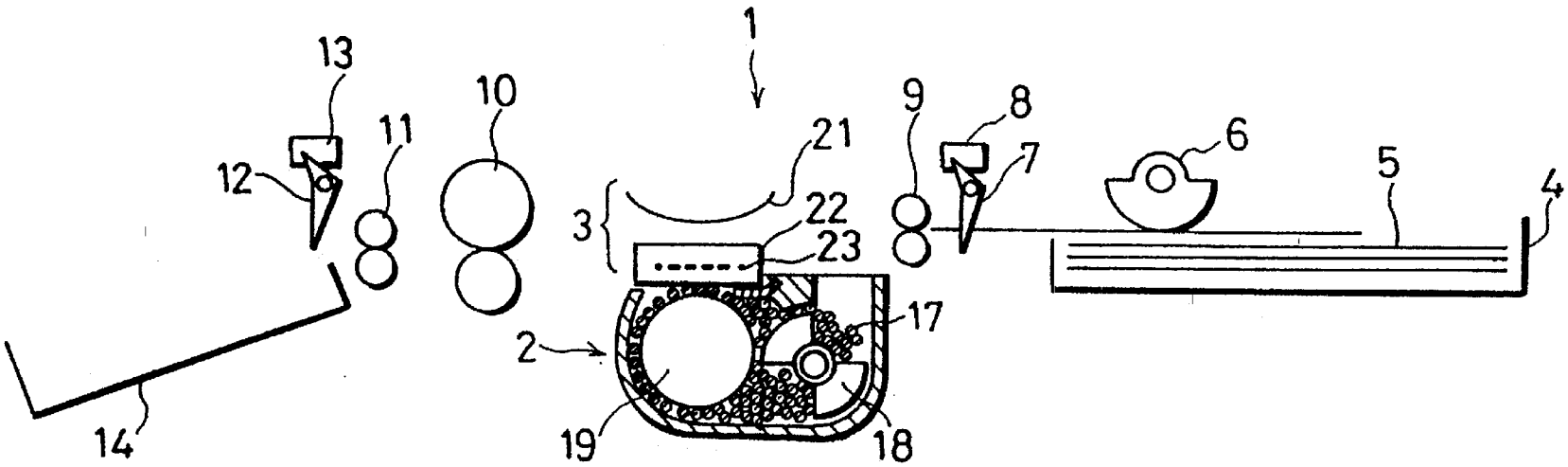
FIG. 4 is a front view which schematically shows a whole arrangement of the digital copying apparatus.

As shown in FIG. 4, the digital copying apparatus of the present embodiment includes an image forming section 1 composed of a toner supplying section 2 and a printing section 3. The image forming section 1 develops an image according to an image signal on a sheet which is a recording medium by using toner as developing particles. More specifically, the digital copying apparatus allows the toner to fly so that the toner adheres to the sheet, and directly form an image on the sheet by controlling the flying of the toner based upon the image signal.

A sheet cassette 4 for storing sheets 5 which are a recording medium, a feed roller 6 for feeding the sheet 5 from the sheet cassette 4, a sheet detecting member 7 activated by driving of the fed sheet 5, a feeding sensor 8 for detecting that the sheet 5 is fed by the activation of the sheet detecting member 7 and a register roller 9 for feeding the sheet 5 fed from the sheet cassette 4 to the image forming section 1 at prescribed intervals are provided to a sheet feeding side of the image forming section 1. Moreover, a fixing section 10 for fixing a toner image which has been formed on the sheet 5 in the image forming section 1, on the sheet 5 by heat or pressure or both of them, a discharge roller 11 for discharging the sheet 5 processed in the fixing section 10 onto a discharge tray 14, mentioned later, a sheet detecting member 12 which is activated by driving of the sheet 5 to be discharged, a discharge sensor 13 for detecting that the sheet 5 is discharged by the activation of the sheet detecting member 12 and the discharge tray 14 receiving the discharged sheet 5 are provided to a discharge side of the image forming section 1. The feed roller 6, the register roller 9, the discharge roller 11, etc. are driven by a main motor, not shown.

Figure 5:
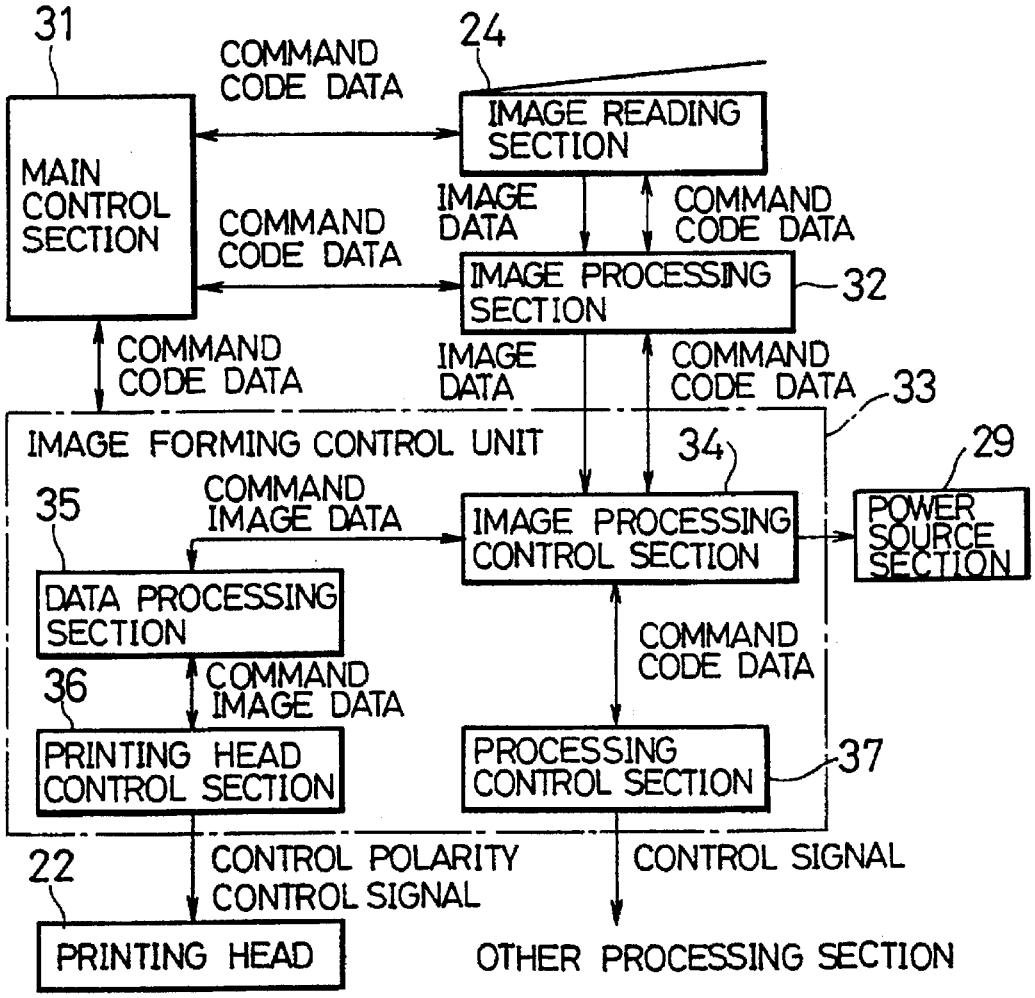
FIG. 5 is a block diagram which shows an arrangement of a control circuit provided to the digital copying apparatus.

In addition, as shown in FIG. 5, the digital copying apparatus includes a main control section 31 for controlling the whole digital copying apparatus, an image processing section 32 for converting image data obtained from an image reading section 24 into image data to be printed, an image forming control unit 33 and a power source section 29 (electric field forming means) for applying a potential to each electrode section of the image forming section 1, etc.

The image reading section 24, for example, scans a document positioned on a transparent document platen by optical scanning means, and converts its reflecting light into an image signal by a CCD (Charge Coupled Device) so that image data are obtained. The image processing section 32 which includes a semiconductor memory and an image memory composed of a magnetic recording medium such as a hard disk, for example, performs the above process on the image data obtained by the image reading section 24 and stores the processed image data in the image memory.

The image forming control unit 33 includes an image forming control section 34, a data processing section 35, a printing head control section 36 which composes a potential control means of a control electrode 23 (mentioned later) together with the image forming control section 34 and the data processing section 35, and a process control section 37. The image forming control section 34 converts the image data obtained from the image processing section 32 into image data to be supplied to the printing head control section 36. More specifically, a graphic character code which is shown by the image data is converted into a dot list. Moreover, the image forming control section 34 applies a voltage to be outputted from the power source section 29 to each electrode section of the image forming section 1. The data processing section 35 decomposes the image data processed in the image forming control section 34 according to a number of rows of the control electrode 23, further mentioned later. The printing head control section 36 generates a control electrode control signal for controlling the potential of the control electrode 23 based upon the image data inputted from the data processing section 35 and supplies it to the printing head 22. The process control section 37 gives a control signal suitable for each process to each section according to a command from the image forming control section 34.

Figure 6:
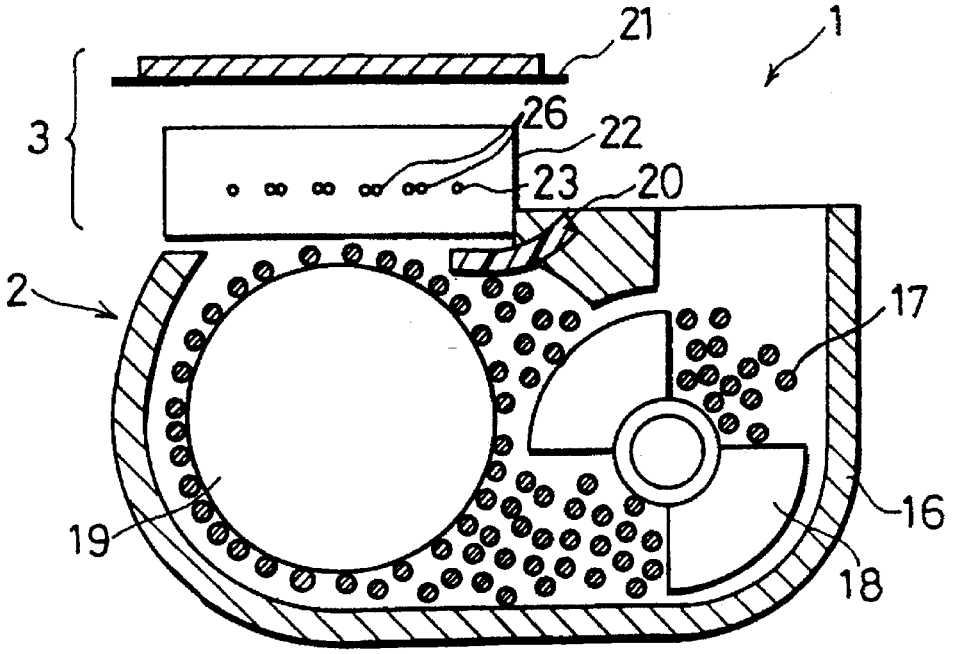
FIG. 6 is a cross section which schematically shows the image forming section.

As shown in FIG. 6, the toner supplying section 2 of the image forming section 1 stores toner 17 as developing particles into a toner storing tank 16. The toner supplying section 2 includes an agitating roller 18 for agitating the toner 17 so that the toner 17 is charged and a toner holder 19 as a cylindrical holder for holding the toner 17 by electric force or magnetic force, or both of them. A thickness of a toner layer held on the outer circumference of the toner holder 19 is controlled by a doctor blade 20 provided to the toner storing tank 16.

The printing section 3 includes a counter electrode 21 which is opposite to the outer circumference of the toner holder 19 and the printing head 22 provided between the counter electrode 21 and the toner holder 19. The counter electrode 21 is made of a plane electrically conductive plate positioned parallel with the surface of the control electrode 23, or an electrically conductive plate with cylindrical surface whose contact surface is parallel with the surface of the control electrode. An electric field, which is stronger or weaker than a toner flying start electric field required for allowing the toner 17 held by the toner holder 19 to fly towards the counter electrode 21, is formed on the vicinity of the toner holder 19 by a voltage to be applied across the toner holder 19 and the counter electrode 21 by the power source section 29.

The printing head 22 provided with the control electrode 23 controls a voltage to be supplied from the power source section 29 to the control electrode 23 based upon the control electrode control signal to be supplied from the printing head control section 36. The control electrode 23 two-dimensionally spreads parallel with the counter electrode 21 and oppositely to the counter electrode 21. The control electrode 23 has a structure that ensures passing of the toner current from the toner holder 19 to the counter electrode 21, namely, its structure is a grid, for example. Then, the electric field formed between the toner holder 19 and the counter electrode 21 changes due to the potential supplied to the control electrode 23, and the flying of toner 17 from the toner holder 19 to the counter electrode 21 is controlled.

Here, in the case where the electric field between the toner holder 19 and the counter electrode 21 is stronger than the toner flying starting electric field, the potential given to the control electrode 23 based upon the control electrode control signal prevents the flying of the toner 17, whereas in the case where the electric field is weaker than the toner flying starting electrode, it allows the toner 17 to fly.

Figure 7:
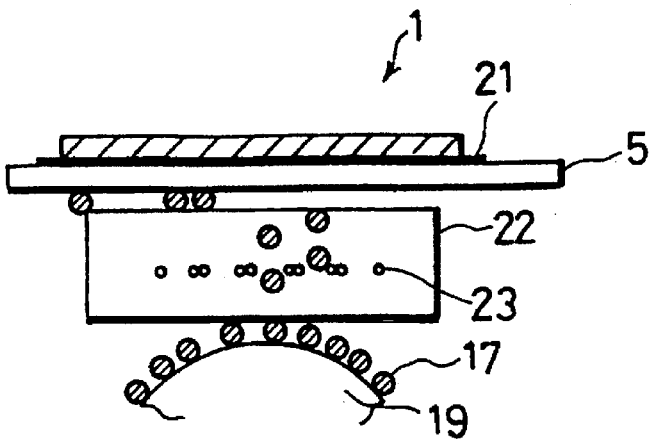
FIG. 7 is an explanatory drawing which explains an image forming operation in the image forming section.

In addition, an image is formed by using the toner 17 in the image forming section 1 according to the following principle. In general, in the case where charged particles are positioned on a boundary surface of air (vacuum) and a material, attractive force is generated between the boundary surface and the charged particles by electrostatic force. This is generally know from a viewpoint of electromagnetism. Therefore, the toner 17 is held on the surface of the toner holder 19 by the electrostatic force. In this state, when an electric field on the surface of the toner holder 19 becomes strong enough to separate the toner 17 and the toner holder 19, which are electromagnetically attracted, from each other, the toner 17 is removed from the toner holder 19, and is accelerated by force of the electric field so as to be transferred towards a specific direction. Therefore, the electric field which makes it possible to allow the toner 17 held on the toner holder 19 to fly towards the counter electrode 21 is generated on the surface of the toner holder 19 according to a relationship among the potential given to the control electrode 23, the potentials of the toner holder 19 and the counter electrode 21. Then, as shown in FIG. 7, the electric field allows the toner 17 to pass through the control electrode 23 and to fly to the counter electrode 21. In this case, when the potential given to the control electrode 23 is controlled according to an image signal and the sheet 5 is positioned on the side of the counter electrode 21 opposite to the toner holder 19, a toner image according to the image signal is formed on the sheet 5. Here, the electric field that the toner 17 starts to fly is called as a toner flying starting electric field Eth, it takes the value $1.0\times10^6$ (V/m) in a certain experiment, for example.

Figure 2:
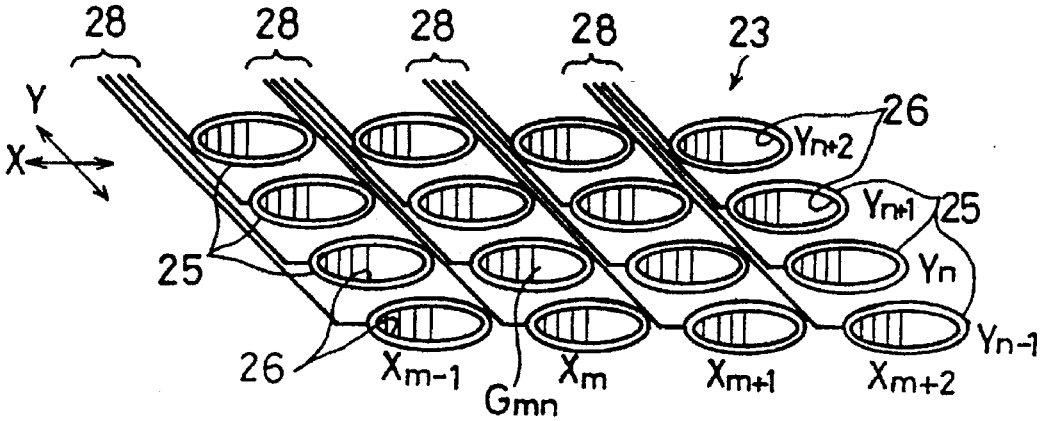
FIG. 2 is a perspective view which shows a wiring state of the feeders which are connected to ring-like electrodes on the control electrode.

As shown in FIG. 2, the control electrode 23 is arranged such that a plurality of ring-like electrodes 25 which are ring-like electric conductors made of copper, stainless, etc. which are independent each other, are positioned in a direction of X and a direction of Y which is perpendicular to the direction of X respectively. An inside of each ring-like electrode 25 is a passing section of the toner 17 flying from the toner holder 19 to the counter electrode 21. Hereinafter, the passing section is referred to as a gate 26.

Figure 1:
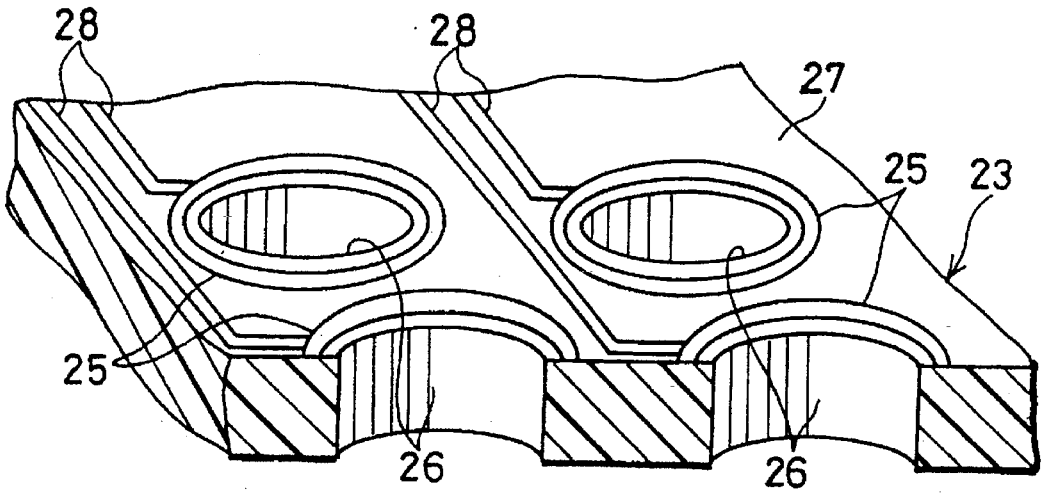
FIG. 1 is a perspective view of a main section which shows a control electrode in an image forming section included in a digital copying apparatus as an image forming apparatus in one embodiment of the present invention.

As shown in FIG. 1, the control electrode 23 is arranged such that holes which are the gates 26 are formed on an insulating control electrode substrate (insulating layer) 27 and that ring-like electrodes (electrode layer) 25 which are insulated from each other are formed around the holes on one surface of the control electrode substrate 27 by an evaporating method, a photo-etching method, etc. A feeder 28 is connected to each ring-like electrode 25, and each feeder 28 is insulated. In FIG. 1, in order to make an arrangement of the control electrode 23 clear, a thickness of the ring-like electrodes 25 and a thickness of the feeders 28 are ignored. Furthermore, the control electrode 23 may be arranged such that the ring-like electrodes 25 and the feeders 28 are stuck to the control electrode substrate 27 by an adhesive, etc.

Figure 3:
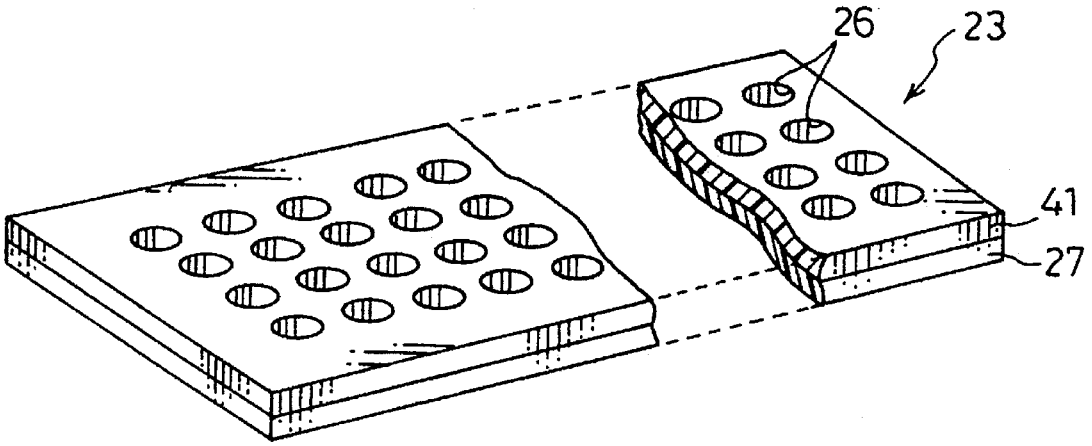
FIG. 3 is a perspective view including a cross section which shows two layered structure of the control electrode.

In addition, as shown in FIG. 3, an electrode protective layer (protective layer) 41 having holes corresponding to the gates 26 are formed on a surface of the control electrode substrate 27 where the ring-like electrodes 25 are provided. The electrode protective layer 41 further improves insulation between the ring-like electrodes 25 insulation between the feeders 28 and insulation between the ring-like electrodes 25 and the feeders 28 which are not connected to one another. Moreover, the electrode protective layer 41 protects the ring-like electrodes 25 and the feeders 28, namely, a main body of the control electrode 23 so as to further improves environmental resistance and service life, etc. of the main body of the control electrode 23. The electrode protective layer 41 is arranged such that a synthetic resin (mentioned later) is applied to the surface of the control electrode substrate 27 and the synthetic resin is hardened, or such that a resin film is stuck to the surface of the control electrode substrate 27 by using adhesive, etc.

The control electrode substrate 27 and the electrode protective layer 41 are formed like a film, and they are made of synthetic resin having electron attractiveness stronger than that of thermoplastic resin contained in the charged toner 17. In other words, in the case where the resin of the toner 17 is polystyrene, for example, the control electrode substrate 27 and the electrode protective layer 41 is made of synthetic resin having electron attractive stronger than that of the polystyrene. Examples of the above synthetic resin are epoxy resin, polyacrylonitrile, fluororesin, or polystyrene obtained by a polymerizing styrene derivative containing electron attractive group which are halogen group, such as chloro group, etc., and nitro group, but the examples are not limited to them. The control electrode substrate 27 and the electrode protective layer 41 may be made of same synthetic resin, and also of different synthetic resin. In the control electrode 23, when the toner 17 which is charged particles flies, for example, its flying direction is deviated due to collision of each toner, and a part of the toner 17 contacts with the control electrode substrate 27 or the electrode protective layer 41. Thereafter, the vicinity of the contact portion of the control electrode substrate 27 or the electrode protective layer 41 receives a part of charges from the toner 17 so as to be negatively charged. Therefore, since electrostatic force (repulsive force) acts between negative charges of the contact portion of the control electrode substrate 27 or the electrode protective layer 41 and the negative charges of the toner 17, and thus they repulse each other, the toner 17 does not adhere to the control electrode substrate 27 or the electrode protective layer 41. Namely, the toner 17 is not held on the surface of the control electrode substrate 27 or of the electrode protective layer 41 or a circumferential surface of the gates 26. Moreover, particles other than the toner 17, such as negatively charged dust, is not held on the control electrode substrate 27 or the electrode protective layer 41.

In the case where positively charged toner is used, the control electrode substrate 27 and the electrode protective layer 41 are made of synthetic resin having electron repelling stronger than that of thermoplastic resin of the toner. In other words, in the case where the resin of the toner is polystyrene, for example, the control electrode substrate 27 and the electrode protective layer 41 are made of synthetic resin having electron repelling stronger than that of the polystyrene. Examples of the above synthetic resin are polyethylene glycol; polyamide; polysytrene obtained by a polymerizing styrene derivative containing an electron donating group such as amino group, hydroxyl group; and polyamide containing the above electron donating group, but the examples are not limited to them. The control electrode substrate 27 and the electrode protective layer 41 may be made of same synthetic resin, and also of different synthetic resin. When the control electrode substrate 27 and electrode protective layer 41 are formed by using the synthetic resin having strong electron repelling, the positively charged toner is not held on the surface of the control electrode substrate 27 or of the electrode protective layer 41, or the circumferential surface of the gates 26. Moreover, particles other than the toner, such as positively charged dust, is not held on the control electrode substrate 27 or the electrode protective layer 41.

Next, the following will explain one example of a method for producing the control electrode 23.

First, a metal film which becomes the ring-like electrodes 25 and the feeders 28 is formed on a side of a resin film which becomes the control electrode substrate 27 by using the evaporating method, etc. A thickness of the resin film and the metal film is not particularly limited, but for example, about 25 μm is suitable for the thickness of the resin film, and about 18 μm is suitable for the thickness of the metal film. Next, the metal film is patterned by a photo-etching method, etc. so that the ring-like electrodes 25 and the feeders 28 are formed. Then, a resin layer which becomes the electrode protective layer 41 is formed by the application, sticking, etc. so that the resin layer covers the one side of the resin film including the ring-like electrodes 25 and the feeders 28 Thickness of the resin layer is not particularly limited. Thereafter, the holes which are the gates 26 are provided on the resin film and the resin layer by a laser processing method, etc. so that the control electrode substrate 27 and the electrode protective layer 41 are finished. The control electrode 23 is produced in the above manner.

Here, in the present embodiment, for convenience of the explanation, as shown in FIG. 2, the ring-like electrodes 25 are placed in four lines in a direction of X, namely, Xm−1, Xm, Xm+1 and Xm+2, and in four lines in a direction of Y, namely, Yn−1, Yn, Yn+1 and Yn+2. In this case, the gate 26 positioned in the line Xm and in the line Yn is represented by the gate Gmn. Moreover, in the case where the direction of Y is a direction where the sheet 5 is transported in the printing section 3, at least 2 and more gates 26 are provided in the direction of Y.

Figure 8:
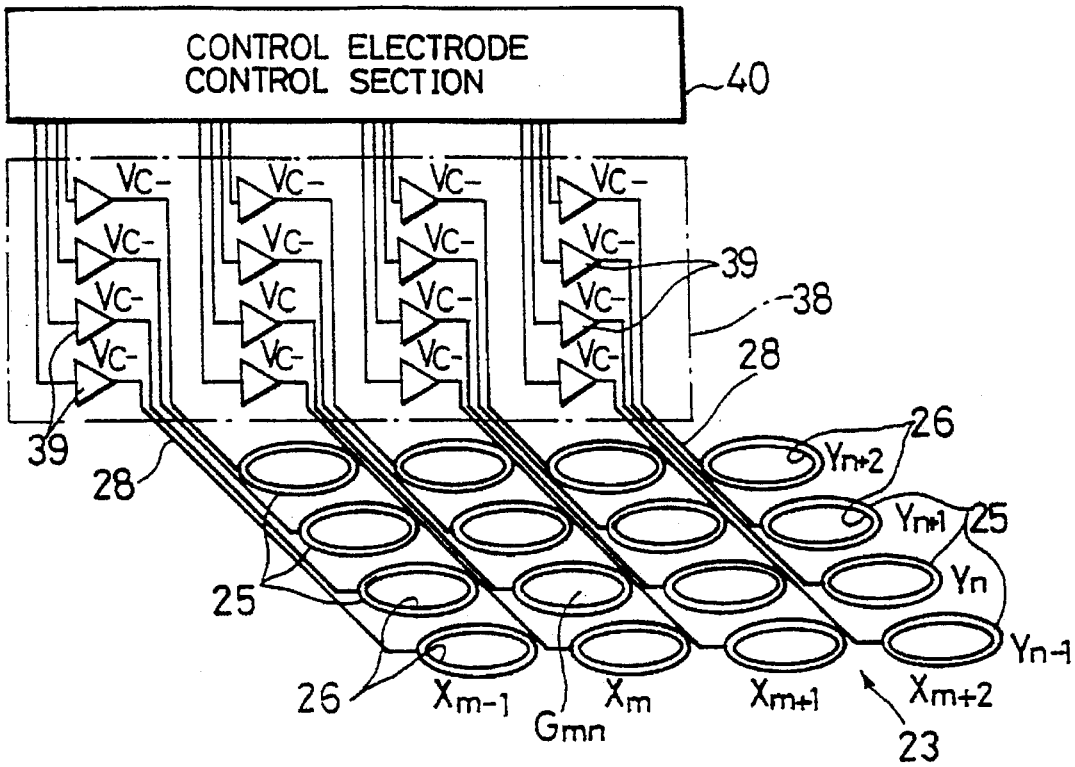
FIG. 8 is an explanatory drawing which explains an arrangement that gives a potential to the control electrode.

As shown in FIG. 8, each ring-like electrode 25 is connected to each driver 39 in a high-voltage driver section 38 which is individually provided correspondingly to each ring-like electrode 25 through each feeder 28 connected to each ring-like electrode 25. Each driver 39 is connected to a control electrode control section 40 (control electrode control means) for controlling each driver 39 according to the control electrode control signal supplied from the printing head control section 36. The high-voltage driver section 38 and the control electrode control section 40 are provided to the printing head 22. In a state shown in FIG. 8, a toner flying potential Vc which makes the flying of the toner 17 from the toner holder 19 to the counter electrode 21 possible is applied only to the gate Gmn by the driver 39, and a toner flying suppressing potential Vc− which prevents the flying of the toner 17 is applied to the other gates 26.

Figure 9C:
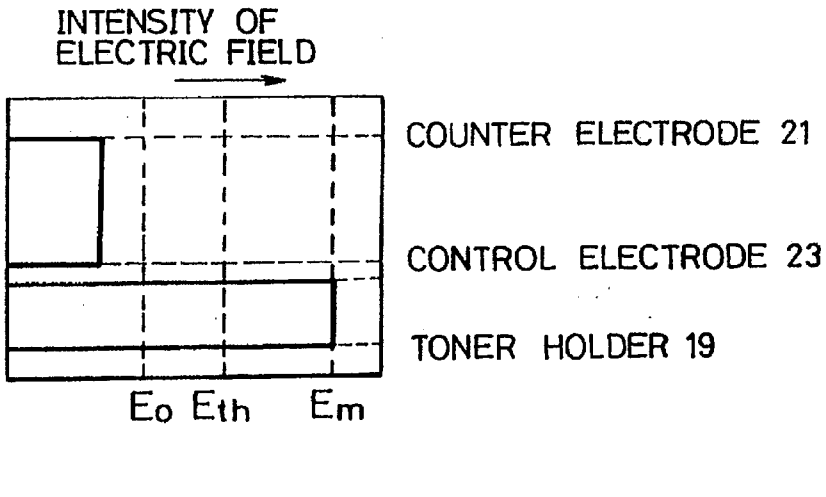
FIG. 9(*a*) is a cross section which schematically shows the image forming section.
Figure 9B:
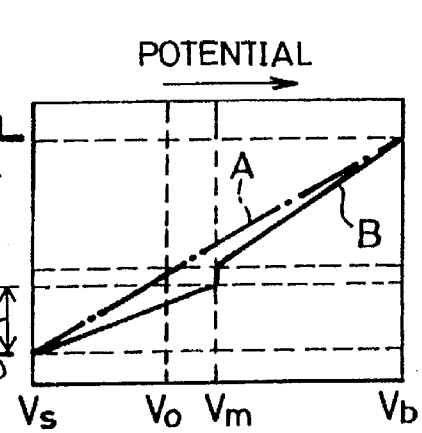
Figure 9A:
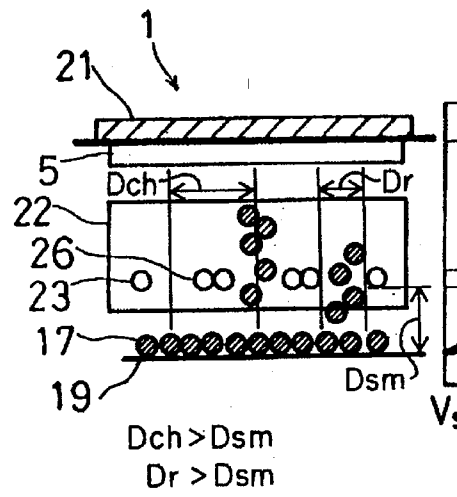

The control electrode 23 is provided such that a pitch of the gate 26 (i.e. the distance between adjacent gates shown as "Dch" in FIG. 9(*a*)), is larger than a distance between the toner holder 19 and the control electrode 23 ("Dsm" in FIG. 9(*a*)). Moreover, the control electrode 23 is provided such that a diameter of the gate 26 is larger than the distance between the toner holder 19 and the control electrode 23. However, the diameter of the gate 26 is not a diameter of the hole, etc. formed on the control electrode substrate 27 but a diameter concerned with potential of the gate 26 (represented by Dr in FIG. 9(*a*), namely, an inside diameter of the ring-like electrode 25. With the above arrangement, influence of a change in the electric field of the gate 26 due to application of the potential to the control electrode 23 is surely exerted upon the surface of the toner holder 19, and the flying of the toner 17 from the toner holder 19 to the counter electrode 21 is satisfactorily controlled.

The following will explain an image forming operation by using the digital copying apparatus.

First, a document to be copied is positioned on the image reading section 24 shown in FIG. 5, and when a copy starting button (not shown) is operated, the main control section 31 which receives the input starts the image forming operation. In other words, a document image is read by the image reading section 24, and its image data are processed in the image processing section 32 so as to be stored in the image memory. Moreover, when the main motor, not shown, is actuated, the sheet 5 in the sheet cassette 4 is sent out towards the image forming section 1 by the feed roller 6 shown in FIG. 4 which is driven by the main motor. When the sheet detecting member 7 is pushed up by the sheet 5, the feed sensor 8 detects the normal sheet feeding state. Thereafter, an leading end of the sheet 5 contacts with the register roller 9 at rest, and the image forming operation is temporarily suspended.

When the feed sensor 8 detects the normal sheet feeding, the image data stored in the image memory are transmitted to the image forming control unit 33. In the image forming control unit 33, the inputted image data starts to be converted into the control electrode control signal to be supplied to the printing head 22. Moreover, when the image forming control unit 33 obtains a prescribed amount of the control electrode control signals, the register roller 9 is actuated so that the sheet 5 is carried to a side of the counter electrode 21 which is opposite to the toner holder 19 in the printing section 3 of the image forming section 1. The prescribed amount of the control electrode control signal differs with the arrangement of the digital copying apparatus, etc.

Thereafter, the image forming control unit 33 supplies the control electrode control signal to the printing head 22. The control electrode control signal is supplied at a timing that is synchronized with the feeding of the sheet 5 to the printing section 3 by the register roller 9. In the printing head 22, the control electrode control section 40 shown in FIG. 8 controls each driver 39 in the high-voltage driver section 38 based upon the control electrode control signal. As a result, a voltage is suitably applied from the driver 39 to the prescribed ring-like electrode 25 so that the electric field in the vicinity of the printing head 22 is controlled. In other words, in the gate 26 of the control electrode 23, the flying of the toner from the toner holder 19 to the counter electrode 21 is suitably prevented or the prevention is released according to the image data. As a result, a toner image according to the image signal is formed on the sheet 5.

The sheet 5 on which the toner image has been formed is carried to the fixing section 10, and the toner image is fixed on the sheet 5 therein. The sheet 5 on which the toner image has been fixed is discharged on the discharge tray 14 by the discharge roller 11. At this time, the sheet detecting member 12 is pushed up by the sheet 5, and the discharge sensor 13 detects that the sheet 5 is normally discharged. According to the detecting operation, the main control section 31 judges that the printing operation normally ends In the case where an electric field between the toner holder 19 and the counter electrode 21, which is generated by applying the voltage across the toner holder 19 and the counter electrode 21, is weaker than the toner flying start electric field Eth, a potential, which is given to the control electrode 23 based upon the control electrode control signal, allows the toner 17 to fly. In other words, as shown in FIG. 9(*b*), when a potential of the toner holder 19 is Vs, a potential of the counter electrode 21 is Vb, a potential to be given to the control electrode 23 is Vm and a potential before the potential Vm is given to the control electrode 23, which is generated on the control electrode 23 by applying the voltage across the toner holder 19 and the counter electrode 21, is Vo, the potential Vm becomes higher than the potential Vo in the image forming section 1 shown in FIG. 9(*a*). Therefore, when the potential Vm is given to the control electrode 23, a change in a potential curve from the toner holder 19 to the counter electrode 21 is represented by a potential change line B, whereas a change in the potential from the toner holder 19 to the counter electrode 21 before the potential Vm is given to the control electrode 23 is represented by a potential change line A.

In addition, as shown in FIG. 9(*c*), when the toner flying start electric field is Eth, intensity of the electric field when the potential Vm is given to the control electrode 23 is Em and intensity of the electric field before the potential Vm is given to the control electrode 23 is Eo, the intensity of the electric field Em in the vicinity of the toner holder 19 becomes stronger than the toner flying start electric field Eth according to the above changes in the potentials.

Figures 10A, 10B, 10C:
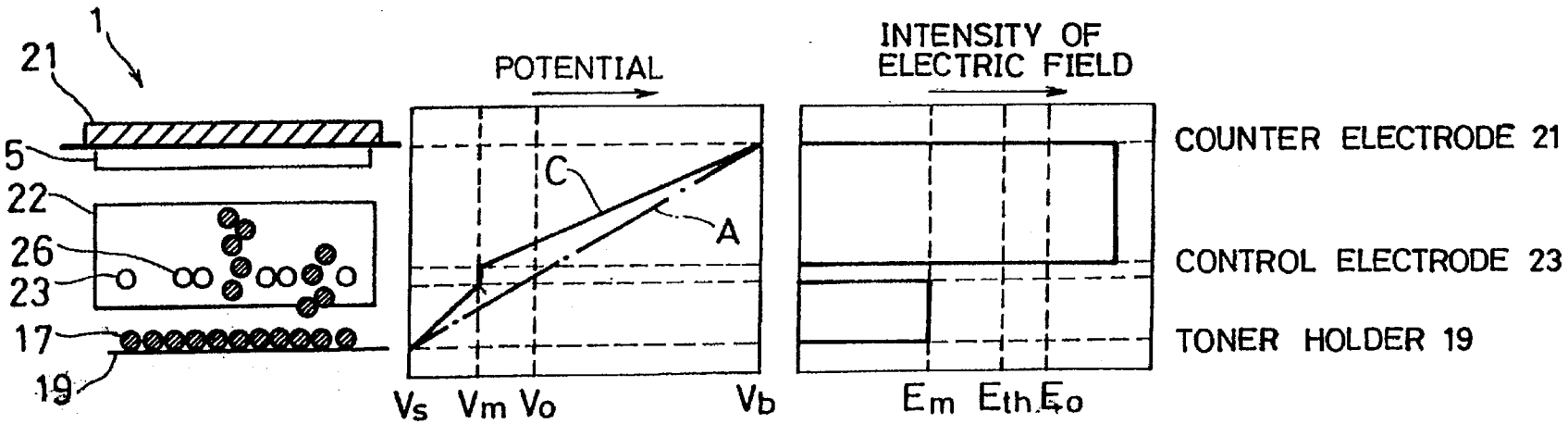
FIG. 10(*a*) is a cross section which schematically shows the image forming section.

Meanwhile, in the case where the electric field between the toner holder 19 and the counter electrode 21, which is generated by applying the voltage across the toner holder 19 and the counter electrode 21, is stronger than the toner flying start electric field Eth, the potential given to the control electrode 23 prevents the flying of the toner 17. In other words, in the image forming section 1 shown in FIG. 10(*a*), as shown in FIG. 10(*b*), the potential Vm becomes lower than the potential Vo. Therefore, when the potential Vm is given to the control electrode 23, a change in the potential from the toner holder 19 to the counter electrode 21 is represented by a potential change line C. Moreover, as shown in FIG. 10(*c*), the intensity of the electric field Em in the vicinity of the toner holder 19 becomes weaker than the toner flying start electric field Eth according to the above change in the potential.

As is clear by comparing the control shown in FIG. 9 with the control shown in FIG. 10, the potential to be given to the control electrode 23 can be set lower in the control of FIG. 10. Therefore, in the control of the flying of the toner viewed from the potential to be given to the control electrode 23, the control of FIG. 10 is more advantageous because in the control of FIG. 9, an output voltage from the power source section 29 which gives the potential to the control electrode 23 is lowered and withstand voltage of power source components and of the voltage applying section is inferior. On the contrary, viewed from influence at the time of a breakdown of the control electrode 23 due to its unsuitable potential, the control of FIG. 10 provides a black-solid image, but the control of FIG. 9 only provides a blank image. Therefore, the control of FIG. 9 is more advantageous.

As mentioned above, in the digital copying apparatus of the present embodiment, the control electrode 23 having the gates 26 which are passing sections for the negatively charged toner 17 is arranged such that the ring-like electrodes 25 are formed on the control electrode substrate 27 made of the synthetic resin having electron attractiveness stronger than that of the synthetic resin contained in the toner 17. Moreover, the electrode protective layer 41, which protects the ring-like electrodes 25 and which is made of the synthetic resin having electron attractiveness stronger than that of the synthetic resin contained in the toner 17, is formed on the surfaces of the ring-like electrodes 25, namely, on the surface of the control electrode substrate 27. For this reason, in the control electrode 23, when the toner 17 which is charged particles flies to contact with the control electrode substrate 27 or the electrode protective layer 41, the contact portion of the control electrode substrate 27 or the electrode protective layer 41 receives charges partly from the toner 17 to be negatively charged. Therefore, electrostatic force (repulsive force) acts between negative charges of the contact portion of the control electrode substrate 27 or the electrode protective layer 41 and the negative charges of the toner 17, and thus the charges repulse each other. Therefore, the toner 17 does not adhere to the control electrode substrate 27 or the electrode protective layer 41. Namely, the toner 17 is not held on the surface of the control electrode substrate 27 or the electrode protective layer 41.

In such a manner, since the adhesion of the negatively charged toner 17 to the control electrode 23 is prevented, the gates 26 are not blocked. As a result, even after long or frequent use of the control electrode, the flying of the toner 17 can be stably controlled by the control electrode 23, and an image with excellent quality can be obtained. This can provide the digital copying apparatus which is capable of stably obtaining an image with excellent quality for a long time without a breakdown even if the control electrode 23 is not maintained, namely, cleaned, replaced, etc. Moreover, the above-mentioned maintenance is not necessary, thereby holding down running cost.

In addition, since the adhesion of the toner 17 can be prevented without the special arrangement of the control electrode 23, the producing of the control electrode 23 does not require trouble and cost. In order to further prevent the adhesion of the negatively charged toner 17 to the control electrode 23, for example, an ultrasonic vibrating equipment for giving ultrasonic vibration to the control electrode, or an air flow generating unit for generating air flow in the gates 26, etc. may be provided.

The present embodiment explained the digital copying apparatus with the arrangement corresponding to the negatively charged toner in detail, but in the case where positively charged toner is used, the functions and effects same as the above can be obtained by setting a polarity of each applied voltage accordingly.

Here, the present embodiment explained the control electrode 23 giving an example of the case where the ring-like electrodes 25 are provided on one side of the control electrode substrate 27, but the control electrode may be arranged such that the ring-like electrodes are provided on both the sides of the control electrode substrate. Moreover, the present embodiment explained the case where the electrode protective layer 41 is provided to the control electrode 23, but the electrode protective layer 41 may be provided according to demand. Therefore, the control electrode may not be provided with the electrode protective layer.

In addition, the counter electrode 21 may be a flat plate in FIG. 6, a plate having a cylindrical surface of FIG. 4 as well as a cylinder. When an image is formed, the counter electrode 21 can functions as a carrying guide for the sheet 5 which is carried on a side of the counter electrode 21 opposite to the toner holder 19. As a result, an exclusive carrying guide is not required, thereby making it possible to miniaturize the apparatus and to simplify its arrangement.

The present embodiment explained the case where the arrangement of the image forming apparatus of the present invention is applied to the digital copying apparatus, but the present invention can be provided to a printing section of the facsimile unit, a digital printer, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. An image forming apparatus for forming an image by allowing developing particles to fly, comprising:

negatively charged developing particles;

a holder for holding said developing particles;

a counter electrode provided oppositely to said holder;

electric field forming means for forming an electric field which allows said developing particles to fly by generating prescribed potential difference across said holder and said counter electrode;

a control electrode having a plurality of gates for letting said flying developing particles pass through, said control electrode provided between said holder and said counter electrode; and control electrode control means for changing the electric field formed between said holder and said counter electrode by controlling the potential given to said control electrode so as to control the flying of said developing particles, which pass through each gate, wherein said control electrode includes:

an insulating layer which is made of resin with electron attractiveness stronger than that of resin contained in said developing particles and electrostatically repulses said developing particles because said insulating layer is negatively charged due to contact with said developing particles; and an electrode layer, to which a potential is given, formed on said insulating layer.

2. The image forming apparatus as defined in claim 1, further comprising a protective layer made of resin with electron attractiveness stronger than that of the resin contained in said developing particles, said protective layer formed on said electrode layer.

3. The image forming apparatus as defined in claim 1, wherein said control electrode is arranged such that an interval between adjacent gates is longer than a distance from said holder to said control electrode.

4. The image forming apparatus as defined in claim 1, wherein said control electrode is arranged such that a diameter concerned with a potential of the gates is larger than the distance from said holder to said control electrode.

5. The image forming apparatus as defined in claim 1, wherein said insulating layer is a film.

6. The image forming apparatus as defined in claim 1, wherein said electrode layer includes ring-like electric conductors provided on a circumference of each gate.

7. The image forming apparatus as defined in claim 1, wherein:

said developing particles made of polystyrene resin, said insulating layer is made of epoxy resin.

8. The image forming apparatus as defined in claim 1, wherein:

said developing particles contain polystyrene resin, said insulating layer is made of polyacrylonitrile.

9. The image forming apparatus as defined in claim 1, wherein:

said developing particles contain polystyrene resin, said insulating layer is made of fluororesin.

10. The image forming apparatus as defined in claim 1, wherein:

said developing particles contain polystyrene resin, said insulating layer is made of polystyrene obtained by polymerizing polystyrene derivative having an electron attractive group.

11. The image forming apparatus as defined in claim 1, wherein said counter electrode is a plate.

12. The image forming apparatus as defined in claim 1, wherein said counter electrode is a plate having a cylindrical surface.

13. The image forming apparatus as defined in claim 1, wherein said counter electrode is a cylinder.

14. The image forming apparatus as defined in claim 1, wherein said electric field forming means includes a power source section for generating a potential difference across said holder and said counter electrode so that an electric field, which is weaker than an electric field for starting the flying of said developing particles, is formed.

15. The image forming apparatus as defined in claim 14, wherein:

said control electrode includes electrodes which are insulated from each other and are provided to each gate, said control electrode control means includes a driver for selectively applying a voltage which rises a potential of the gate for passing said developing particles to the electrodes when the power source section generates the potential difference across said holder and said counter electrode.

16. The image forming apparatus as defined in claim 1, wherein said electric field forming means includes a power source section for generating a potential difference across said holder and said counter electrode so that an electric field, which is stronger than an electric field for starting the flying of said developing particles, is formed.

17. The image forming apparatus as defined in claim 16, wherein:

said control electrode includes electrodes which are insulated from each other and are provided for each gate, said control electrode control means includes a driver for selectively applying a voltage, which decreases a potential of the gates for passing said developing particles, to said electrodes when the power source section generates the potential difference across said holder and said counter electrode.

18. An image forming apparatus for forming an image by allowing developing particles to fly, comprising:

positively charged developing particles;

a holder for holding said developing particles;

a counter electrode provided oppositely to said holder;

electric field forming means for forming an electric field which allows said developing particles to fly by generating prescribed potential difference between said holder and said counter electrode;

a control electrode having a plurality of gates for letting said flying developing particles pass through, said control electrode provided between said holder and said counter electrode; and control electrode control means for changing the electric field formed between said holder and said counter electrode by controlling the potential given to said control electrode so as to control the flying of said developing particles, which pass through each gate, wherein said control electrode includes:

an insulating layer which is made of resin with electron repelling stronger than that of resin contained in said developing particles and electrostatically repulses said developing particles because said insulating layer is positively charged due to contact with said developing particles; and an electrode layer, to which a potential is given, formed on said insulating layer.

19. The image forming apparatus as defined in claim 18, further comprising a protective layer made of resin having electron repelling stronger than that of resin contained in said developing particles, said protective layer formed on said electrode layer.

20. The image forming apparatus as defined in claim 18, wherein said control electrode is arranged such that an interval between adjacent gates is longer than a distance from said holder to said control electrode.

21. The image forming apparatus as defined in claim 18, wherein said control electrode is arranged such that a diameter concerned with a potential of the gates is larger than a distance from said holder to said control electrode.

22. The image forming apparatus as defined in claim 18, wherein said insulating layer is a film.

23. The image forming apparatus as defined in claim 18, wherein said electrode layer includes ring-like electric conductors provided on a circumference of each gate.

24. The image forming apparatus as defined in claim 18, wherein:

said developing particles contain polystyrene resin, said insulating layer is made of polyethylene glycol.

25. The image forming apparatus as defined in claim 18, wherein:

said developing particles contain polystyrene resin, said insulating layer is made of polyamide.

26. The image forming apparatus as defined in claim 18, wherein:

said developing particles contain polystyrene resin said insulating layer is made of polystyrene obtained by polymerizing styrene derivative having electron donating group.

27. The image forming apparatus as defined in claim 18, wherein said counter electrode is a plate.

28. The image forming apparatus as defined in claim 18, wherein said counter electrode is a plate having a cylindrical surface.

29. The image forming apparatus as defined in claim 18, wherein said counter electrode is a cylinder.

30. The image forming apparatus as defined in claim 1, wherein said electric field forming means includes a power source section for generating a potential difference across said holder and counter electrode so that an electric field, which is weaker than an electric field for starting the flying of said developing particles, is formed.

31. The image forming apparatus as defined in claim 14, wherein:

said control electrode includes electrodes which are insulated from each other and which are provided to each gate;

said control electrode control means includes a driver for selective applying a voltage, which increases a potential of the gates for passing said developing particles, to said electrodes when the power source section generates the potential difference across said holder and said counter electrode.

32. The image forming apparatus as defined in claim 1, wherein said electric field forming means includes a power source section for generating a potential difference across said holder and said counter electrode so that an electric field, which is stronger than an electric field for starting the flying of said developing particles, is formed.

33. The image forming apparatus as defined in claim 16, wherein:

said control electrode includes electrodes which are insulated from each other and are provided to each gate, said control electrode control means includes a driver for selectively applying a voltage, which decreases a potential of the gates for passing said developing particles, to the electrodes when the power source section generates the potential difference across said holder and said counter electrode.

* * * * *